US008656846B2

(12) United States Patent
Osucha et al.

(10) Patent No.: US 8,656,846 B2
(45) Date of Patent: Feb. 25, 2014

(54) CONTINUOUS REAL TIME HEATING VALUE (BTU)/COAL FLOW BALANCING METER

(75) Inventors: Peter M. Osucha, Knoxville, TN (US); David K. Swindell, Knoxville, TN (US); Jack R. Lee, Lenoir City, TN (US)

(73) Assignee: Energy Technologies, Inc., Knoxville, TN (US)

( * ) Notice: Subject to any disclaimer, the term of this patent is extended or adjusted under 35 U.S.C. 154(b) by 631 days.

(21) Appl. No.: 12/880,744

(22) Filed: Sep. 13, 2010

(65) Prior Publication Data

US 2010/0330517 A1 Dec. 30, 2010

Related U.S. Application Data

(63) Continuation-in-part of application No. 11/414,920, filed on May 1, 2006, now abandoned.

(51) Int. Cl.

| | |
|---|---|
| ***F23K 3/02*** | (2006.01) |
| ***F23N 5/20*** | (2006.01) |
| ***F23K 1/00*** | (2006.01) |

(52) U.S. Cl.

USPC ..... 110/101 CF; 110/186; 110/188; 110/232; 110/263; 110/347; 110/348; 110/106

(58) Field of Classification Search

USPC ..... 110/186, 188, 232, 263, 347, 348, 106, 110/101 CF

See application file for complete search history.

(56) References Cited

U.S. PATENT DOCUMENTS

| | | | | |
|---|---|---|---|---|
| 4,440,097 | A | 4/1984 | Teske | |
| 4,582,992 | A | 4/1986 | Atwell et al. | |
| 4,895,081 | A * | 1/1990 | Homer et al. | 110/101 CC |
| 4,969,408 | A * | 11/1990 | Archer et al. | 110/347 |
| 5,685,240 | A | 11/1997 | Briggs, Jr. et al. | |
| 6,112,676 | A * | 9/2000 | Okazaki et al. | 110/261 |
| 6,362,477 | B1 | 3/2002 | Sowerby et al. | |
| 6,699,030 | B2 * | 3/2004 | Bool et al. | 110/345 |
| 7,006,919 | B2 * | 2/2006 | Osucha et al. | 702/2 |

* cited by examiner

*Primary Examiner* — Kenneth Rinehart
*Assistant Examiner* — David J Laux
(74) *Attorney, Agent, or Firm* — Pitts & Lake, P.C.

(57) ABSTRACT

A method and an apparatus for continuous real time heating value/coal flow balancing of coal from a coal feeder to a burner. The apparatus includes a Dual-energy Gamma Attenuation (DGA)/Multi-energy Gamma Attenuation (MGA) device for measuring coal quality at a specific location between the coal silo/bunker and the coal feeder in a coal fired plant in order to control the individual burner stoichiometries according to the measured coal quality. By strategically placing the DGA/MGA device, continuous accurate real-time coal quality information is accomplished for making individual adjustments in order to improve stoichiometry to optimize performance of the system.

11 Claims, 3 Drawing Sheets

CONTINUOUS REAL TIME HEATING VALUE (BTU)/COAL FLOW BALANCING METER

CROSS-REFERENCE TO RELATED APPLICATIONS

This Application is a continuation-in-part of U.S. patent application Ser. No. 11/414,920, from which it claims priority.

STATEMENT REGARDING FEDERALLY SPONSORED RESEARCH OR DEVELOPMENT

Not Applicable

BACKGROUND OF THE INVENTION

1. Field of Invention

The present invention relates to the use of nuclear response measurements of fuel flow and fuel quality combined with a process control system for optimization of air and coal stoichiometry at each burner in a coal-firing boiler.

2. Description of the Related Art

In the field of coal-firing boilers used especially by utility companies and industrial boiler operators, it is well known that increasingly stringent emissions limits continue to apply pressure to reduce $NO_x$ emissions from coal fired boilers. Years of investigation by utilities, boiler suppliers, and controls suppliers have determined that stoichiometries local to the burners must be maintained to achieve very low $NO_x$ emissions without negatively effecting combustion efficiency or boiler performance. Common barriers to lower $NO_x$ emissions include poor coal and air distribution which may also lead to high unburned carbon, high $CO_x$, boiler slagging, and oxygen and/or steam temperature imbalances.

To date, all low $NO_x$ firing systems are based on a predefined balance of air and coal at the burners. The air/fuel balance is maintained by adjusting the secondary air flow and, in some cases, the coal feed rate. Deviations from the design air/fuel balance at individual burners results in burners operating at a fuel lean or fuel rich condition. A fuel lean burner produces high $NO_x$ levels at elevated $O_2$, resulting in a flue gas with high $CO_x$, high $NO_x$, and increased LOI due to burners operating with poor stoichiometries. A fuel rich burner produces large amounts of $CO_x$, high LOI, and longer flames while lowering the oxygen level in the flue gas. Many coal fired boilers with poor air/fuel distribution experience problems such as: emission problems; increased unburned carbon in fly ash; distorted oxygen profile at the boiler outlet; uneven steam temperature profiles; flame impingement; increased slagging; and water wall heat waste.

In conventional coal handling systems that include adjustments to the coal feed rate as part of maintaining the air/fuel balance, the coal feed rate is based on either volume or weight. In the United States, gravimetric feeders are predominately used to supply coal to the pulverizer based on weight. More specifically, adjustments to the coal feed rate in conventional handling systems are designed to keep the coal flow rate constant for a specified demand.

The inventor of the present invention is a co-inventor of the subject matter disclosed in U.S. Pat. No. 7,006,919, titled "Real time continuous elemental measurement of bulk material," issued on Feb. 28, 2006. In that patent, various methods and an apparatus for continuous real-time measurement of bulk material using gamma irradiation and neutron irradiation is disclosed. The '919 device includes a dual-energy gamma attenuation (DGA) device for monitoring bulk material flow and for producing a spectrum that is compared to a baseline spectrum to produce a relative weight/impurity ratio. A prompt gamma neutron activation analysis (PGNAA) device monitors the same bulk material flow and produces a spectrum that is compared to a library of spectrums to produce a relative component ratio. The relative component ratio is processed with the relative weight/impurity ratio to produce an absolute weight and impurity value, which is then processed with the relative component ratio to produce absolute component, or analyte, values.

The DGA analysis technique involves bombarding a bulk material with gamma rays from two gamma ray emitters of sufficiently different energies. The gamma rays interact with the bulk material resulting in the attenuation of the number of gamma rays transmitted through the bulk material. The gamma rays are typically detected by a scintillation crystal (typically NaI). The sum of these released gamma rays at these specific energies is referred to as an energy spectrum. The technology relies on the fact that elements with different atomic numbers attenuate gamma rays at specific energies in different ways. Thus, for low-energy gamma rays (i.e., those generated by a low energy gamma emitter such as Am-241), the attenuation of gamma rays is largely dependent on the atomic number of the atoms/elements present in the bulk material. For high-energy gamma rays (i.e., those generated by a high-energy gamma emitter such as Cs-137), attenuation is independent of the atoms/elements in the bulk material. Analysis of the energy spectrum leads to a determination of the bulk elemental composition of the bulk material.

DGA based sensors are known in the art. DGA devices are based on the premise that analyzed material will attenuate different energy gamma rays in fixed repeatable ways. A DGA device consists of a gamma energy source arrangement consisting of dual energy gamma emitters. The gamma emitters are chosen in such a way that the material to be analyzed will attenuate the different energy gamma rays in ways that are conducive to measuring one or more specific properties of the material being measured. One such application of DGA technology uses gamma ray sources to interrogate coal, with the assumption that the material of which the coal is composed will attenuate the differing energy gamma rays to produce a measurement that is conducive to determining coal ash content and density.

The multi-energy gamma attenuation (MGA) analysis technique involves the use of several gamma emitters at various energies to determine the bulk material quality and content. The apparatus used in such MGA analysis is a multiple-energy (three or more sources) gamma attenuation analyzer including a shielded source enclosure, a detector assembly, and a structural support framework defining an analysis zone in which the bulk material to be analyzed passes. The apparatus includes an MGA device to determine the absolute material density and content, and a computing/processing system for combining the resultant sensor data into quantities representative of the material quality. The MGA technique has a distinct advantage over the DGA technique in that the atomic/elemental interaction with the gamma energy takes place at several energies that depend on the atomic number of the atom/element encountered. Therefore, knowing the relative attenuation of gamma rays at the energies of interest and the mathematical reduction of a measured energy spectra against the known relative attenuations results in a determination of the quality and content of the bulk material. MGA analysis technique is described in detail in U.S. patent application Ser. No. 10/875,907, filed by Osucha, Swindell and Lee, and published on Dec. 20, 2004 as U.S. Patent Pub. No. 2004/0262524.

The PGNAA technique involves bombarding a bulk material sample with neutrons from a neutron emitter (typically Cf-252). The neutrons collide with atoms/elements in the sample, emitter housing, and/or an external moderator and are captured by the nuclei of atoms/elements present in the sample. The capture process often involves the release of gamma rays at energies specific to the captured atom/element. These gamma rays are detected typically by a scintillation crystal (typically NaI). The sum of the detected gamma energy at these specific energies is an energy spectrum. Analysis of the energy spectrum provides analytical information on the proportion of the various elements present in the bulk material.

As discussed in the '919 patent, various PGNAA based sensor systems are known. One such analyzer is that described in U.S. Pat. No. 4,582,992, titled "Self-Contained, On-Line, Real-time Bulk Material Analyzer," issued to Atwell, et al., on Apr. 15, 1986, which uses PGNAA technology in an attempt to determine the elemental content of the bulk material. The described analyzer uses an arrangement of neutron sources and gamma ray detectors in an enclosed assembly to perform its analysis. A similar device, described in U.S. Pat. No. 6,362,477, titled "Bulk Material Analyser for On-Conveyor Belt Analysis," issued to Sowerby, et al., on Mar. 26, 2002, uses PGNAA technology in a bulk material on-conveyor belt arrangement to analyze bulk material. Again, this analyzer uses a neutron source and gamma ray detectors in an enclosed assembly to perform its analysis.

BRIEF SUMMARY OF THE INVENTION

The present invention is a method and an apparatus for continuous real time heating value/coal flow balancing of coal from a coal silo/bunker to a burner. The apparatus includes a Dual-energy Gamma Attenuation (DGA)/Multi-energy Gamma Attenuation (MGA) device for measuring coal quality information (including heating value) at a specific location (e.g., on the coal feeder tube between the coal silo/bunker and the coal volumetric or gravimetric feeder) in a coal fired plant in order to control the speed of the coal feeder and the introduced air flow based on the measured coal quality information. By strategically placing the DGA/MGA device, continuous accurate real-time coal quality information is acquired and made available for making individual coal feeder speed and air adjustments in order to improve burner stoichiometry, optimize performance of the system, and to balance the energy input (fuel/air) to all burners present in a boiler.

In one embodiment, a system incorporating the apparatus of the present invention includes a coal silo/bunker (hereinafter "bunker") for storing coal. A DGA/MGA device for analyzing coal, including at least one DGA/MGA source and at least one DGA/MGA detector, is installed in a fixed position between the bunker and a coal feeder (which is generally a volumetric or gravimetric feeder). The analyzed coal flows from the bunker through the DGA/MGA device then through the coal feeder onto a coal feeder conveyor (hereinafter "conveyor") or is otherwise moved to a mill or pulverizer (hereinafter "pulverizer"). The coal is pulverized before being combined with air (primary air) in the pulverizer and is then carried by primary air to a burner, where the pulverized coal and primary air are combined with additional air (secondary air) supplied by a secondary air system through at least one actuated damper. The damper is electrically or electromechanically operated to open and close to adjust the volume of secondary air introduced to the burner. The resulting combination of pulverized coal, primary air, and secondary air is ignited in the burner and delivered to the boiler.

The DGA/MGA device positioned between the bunker and the coal feeder performs a real-time ash and heating value analysis of the bulk coal as that coal flows from the bunker to the coal feeder. Natural variation in the heating value of coal (i.e. the amount of heat energy released when a given mass or volume of coal is burned, also known in the art as Btu value) can cause undesired variation in the stoichiometry of the burners supplying fuel and air to a boiler. The presence of impurities in the coal (e.g. moisture, ash, sulfur, etc.) also affects the heating value of the coal. The DGA/MGA device, by analyzing the bulk coal material entering the coal feeder, provides information on the chemical composition of the coal and the presence of impurities, thereby permitting the calculation, in real time, of the heating value of the coal as it enters the coal feeder. (This information on the heating value and impurity content of coal we shall refer to collectively as "coal quality information.")

Coal quality information pertaining to the coal currently passing through the DGA/MGA device, including heating value and, in some embodiments, other information such as moisture content, is collected by the DGA/MGA device and then sent to a processor. The processor is provided for controlling various system components—particularly the amount of coal and the amount of air introduced to the burner—based on the coal quality information received from the DGA/MGA device.

Time delays are established between the time the coal is analyzed by and passes through the DGA/MGA device and the time that the coal is processed through the coal feeder, pulverizer, and burner. The processor uses the coal quality information from the DGA/MGA device to adjust the speed of the coal feeder and the secondary air flow in order to optimize burner stoichiometry. A system employing multiple parallel apparatus, either controlled by the same processor or by individual processors for each apparatus, is used to balance the fuel flow (energy) to all burners for an entire boiler.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

The present invention provides a method and an apparatus for continuous real time heating value/coal flow balancing of coal from a coal silo/bunker to a burner. The apparatus includes a Dual-energy Gamma Attenuation (DGA)/Multi-energy Gamma Attenuation (MGA) device for measuring coal quality information at a specific location in a coal fired plant in order to control the speed of the coal feeder and the introduced air based on the measured coal quality information. By strategically placing the DGA/MGA device, continuous accurate real-time coal quality information is acquired for making individual coal feeder speed and air damper adjustments in order to improve burner stoichiometry, optimize performance of the system, and to balance the energy input (fuel/air) to all burners present in a boiler.

Figure 1:
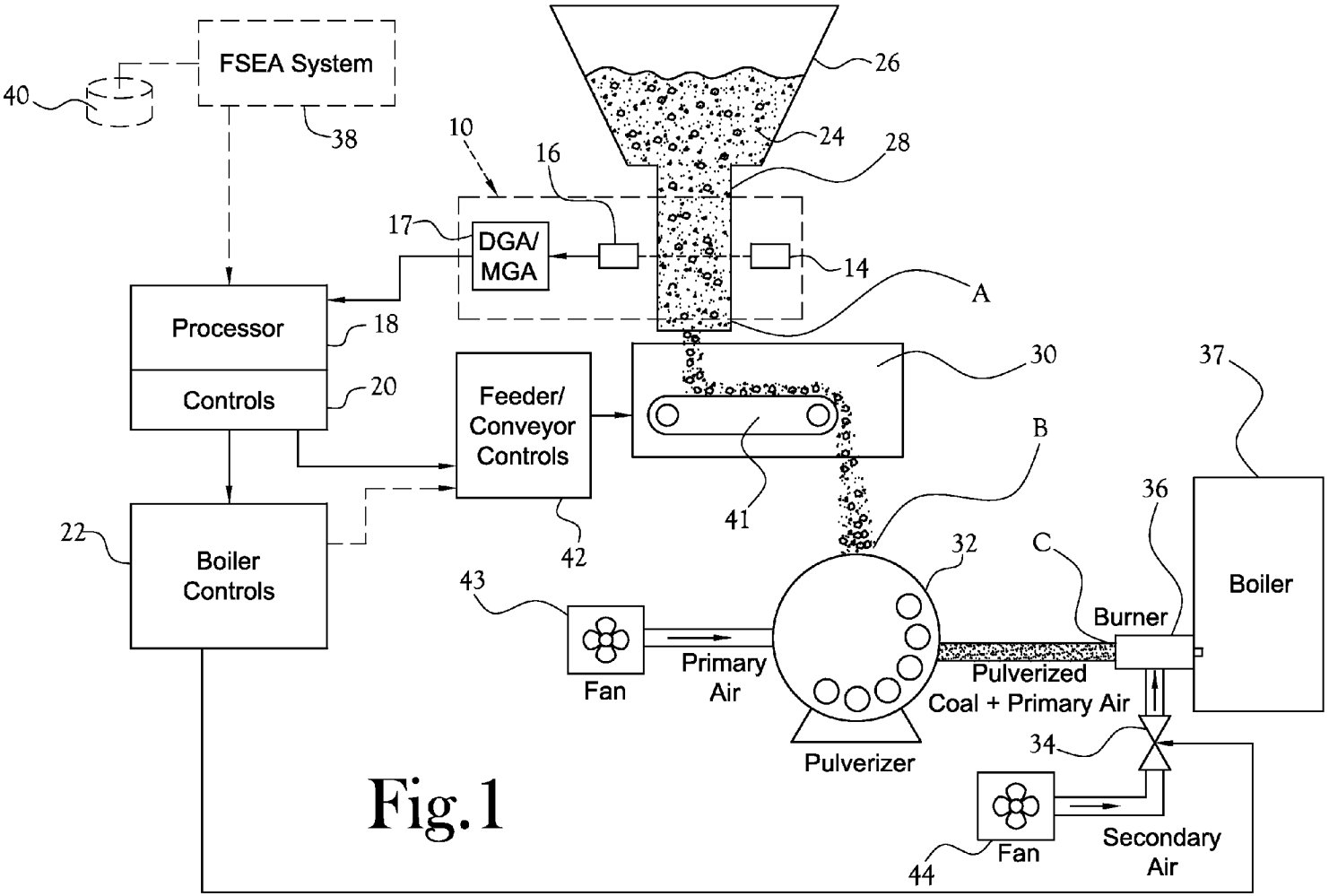
FIG. 1 is a block diagram of one embodiment of the proposed system.
Figure 2:
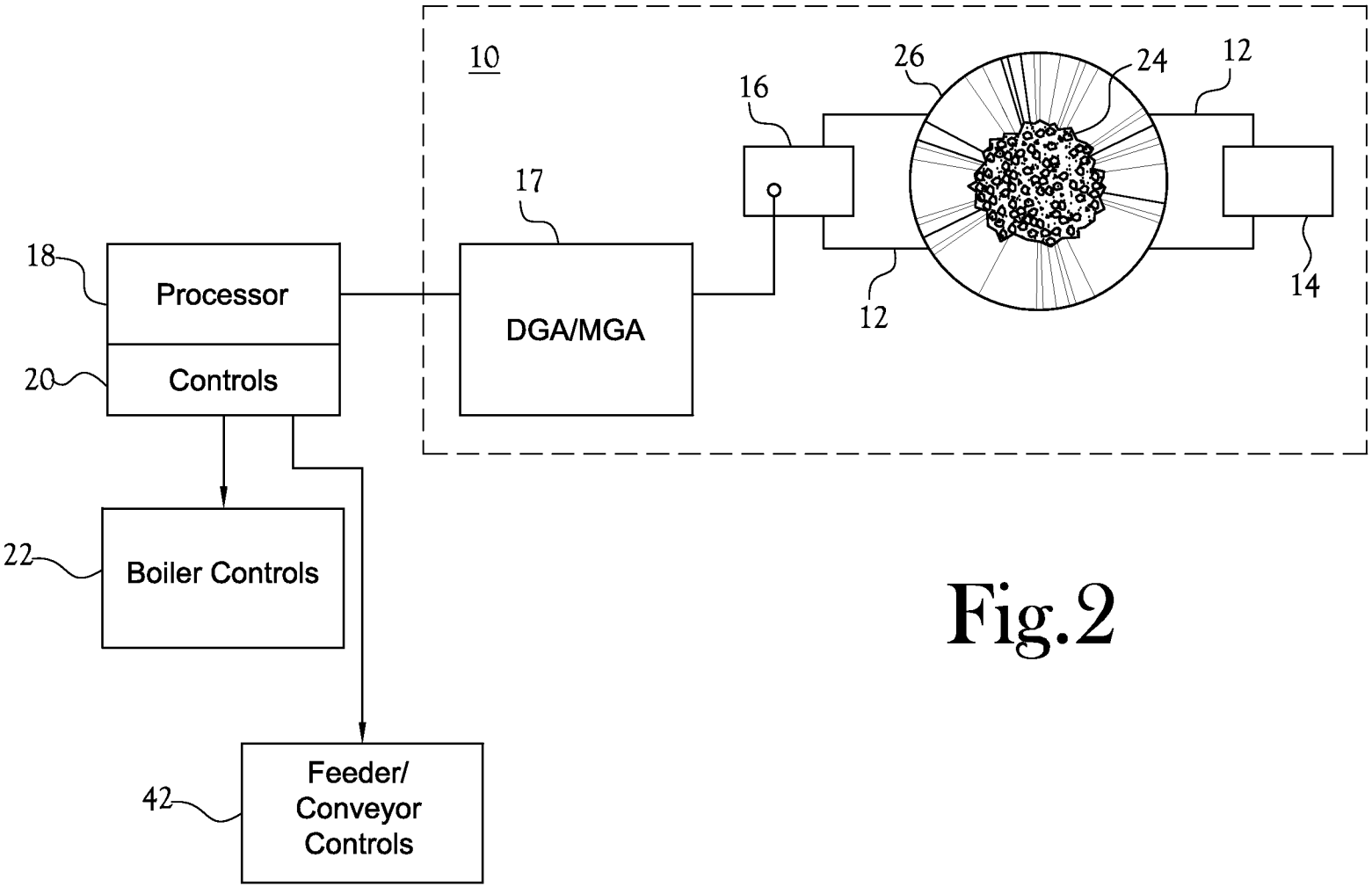
FIG. 2 is a representative diagram of the online measurement process, showing a top-down view of a portion of the embodiment shown in FIG. 1.

The DGA/MGA device of the present invention is illustrated generally at 10 in FIGS. 1 and 2. The DGA/MGA device 10 is mounted relative to a transition tube 28 to acquire the coal quality information of the coal flowing from a bunker 26 to a coal feeder 30. This coal quality information provided by the DGA/MGA device 10 is fed to a processing component or processor 18, where control logic is used to adjust the coal feeder 30 and at least one secondary air damper 34 feeding the burner 36 that feeds the boiler 37, resulting in improved burner stoichiometry.

The coal feeder of the prior art meters the flow of coal to the mill/pulverizer based on volume or weight as opposed to metering the flow of coal based on heating value or other coal quality information. Variability in fuel quality across different feeders and subsequent burners of an entire boiler coupled with primary and secondary air ($O_2$) introduction based upon design conditions rather than actual on-line parameters produces the imbalances discussed above resulting in non-optimized air/fuel mixture. In the present invention, density (flow rate) and coal quality information (including heating value) are continuously measured by the DGA/MGA device 10, and these measurements are used to provide real time adjustment of coal feed to the pulverizer 32 as well as adjustment to the secondary air damper 34 in proximity to the burner 36. The discrete control of this fuel/air balance allows for improved stoichiometries at each individual burner 36 and, in a system with multiple burners feeding fuel and air to a boiler, improved stoichiometries at all burners in a boiler.

One embodiment of a system incorporating the present invention is illustrated in FIG. 1. Coal stored in a bunker 26 passed through a transition tube 28 and a coal feeder 30 to a pulverizer 32. As shown in FIG. 2, a DGA/MGA mounting structure 12 secures at least one DGA/MGA source 14 and at least one DGA/MGA detector 16 in a fixed position between the bunker 26 and the coal feeder 30. As shown in FIG. 1, in the illustrated embodiment, the DGA/MGA source 14 and the DGA/MGA detector 16 are positioned across the transition tube 28 connecting the bunker 26 and the coal feeder 30.

The analyzed coal 24 passes into the coal feeder 30, which in many embodiments is a gravimetric coal feeder. In many embodiments, the coal feeder 30 includes at least one conveyor 41 for conveying the coal through the coal feeder 30 to the inlet of the pulverizer 32. The coal 24 flows onto the conveyor 41 or is otherwise moved to the pulverizer 32. The coal 24 is pulverized before being combined with air from a primary air fan or primary air system 42 feeding the pulverizer 32. The resulting combination of pulverized coal and air (hereinafter "air/fuel mixture") is then delivered to at least one burner 36. Secondary air from a secondary fan or secondary air system 44 is introduced to the air/fuel mixture at the burner 36 by way of the damper 34, which is electrically or electromechanically operated to open and close to adjust the volume of secondary air available to the combustion process.

As shown in FIG. 1, coal quality information pertaining to the coal 24 is acquired by the DGA/MGA device 10 and then sent to the processor 18. The processor 18 is provided for controlling various system components based on the coal quality information received from the DGA/MGA device 10. In some embodiments, the processor 18 includes at least one input/output (I/O) control 20. In some embodiments, the I/O control 20 is in communication with existing boiler controls 22; and in some embodiments the I/O control 20 makes adjustments to the settings of the existing boiler controls 22 in response to the coal quality information obtained via the DGA/MGA device 10. In some embodiments, the I/O control 20 is in communication with the controls 42 for the coal feeder 30; and in some embodiments I/O control 20 makes adjustments to the flow-through rate of the coal feeder 30 or specifically to the speed of the conveyor 41 in response to the coal quality information obtained via the DGA/MGA device 10. In some embodiments, the I/O control 20 is in communication with the damper 34 that feeds secondary air to the burner 36; and in some embodiments I/O control 20 makes adjustments to the volume of air that the damper 34 permits to enter the burner 36. In some embodiments, the I/O control 20 is in communication with some or all of the controls and control systems listed above. In some embodiments, the I/O control is an input and/or output device including but not limited to a plant network card or an Ethernet card.

Time delays are established for the time required for the coal 24 to leave the DGA/MGA device 10 and arrive in the burner 36. The processor 18 establishes a first time delay value based on the time required for the coal 24 to be conveyed from the DGA/MGA device 10 to the pulverizer 32, based on the current velocity of conveyance (i.e. the speed with which the coal feeder 30 moves coal 24 from its inlet near the DGA/MGA device 10 and its outlet near the pulverizer 32; often this will be highly dependent upon the speed of the conveyor 41, i.e. "the conveyor speed"). The processor 18 also establishes a second delay value based on the time required for the coal 24 to be pulverized in the pulverizer 32 and for the pulverized coal to be carried to the burner 36 by the primary air, based on the velocity of the primary air flowing from the pulverizer 32 to the burner 36. In the illustrated embodiment in FIG. 1, the first delay value is based on the time required for the coal 24 to move from point A to point B; and the second delay value is based on the time required for the coal to move from point B to point C. The processor 18 uses the coal quality information pertaining to the coal 24 provided by the DGA/MGA device 10 and the established time delays to adjust the speed of the coal feeder 30 as well as to adjust the secondary air damper 34, thereby controlling the amount of secondary air mixed with the air/fuel mixture for optimal burner stoichiometry. Additional boiler distribution controls and information is obtained as necessary from a boiler distribution control system. Manual override functionality is accomplished by way of existing boiler controls 22.

The present invention in some embodiments further includes a Full Stream Elemental Analyzer (FSEA) 38 such as that described in the aforementioned '919 patent. When incorporated in such a system, the FSEA 38 is in communication with the processor 18 and allows for the incorporation of additional coal quality information (e.g., specific elemental and slagging indices concerning the coal stored in the silo/bunker 26) for use in adjusting the coal feeder 30, conveyor 41, and secondary air damper 34. The FSEA 38 measured indices are stored in a database 40 associated with the FSEA 38 and are communicated to the processor 18.

FIG. 2 is a schematic illustration of the DGA/MGA device 10 of the present invention. The bunker 26 is illustrated in a top plan view, looking into the coal feeder tube 28. The DGA/MGA mounting structure 12 secures at least one DGA/MGA source 14 on one side of the coal feeder tube 28 and at least one DGA/MGA detector 16 on an opposing side. The DGA/MGA detectors 16 are in communication with a DGA/MGA data acquisition unit 17, which monitors the output from the DGA/MGA detectors 16. Data acquired from the DGA/MGA data acquisition unit 17 is communicated to the processor 18. At least one input/output (I/O) control 20 is in communication with the existing boiler controls 22, as described above.

Figure 3:
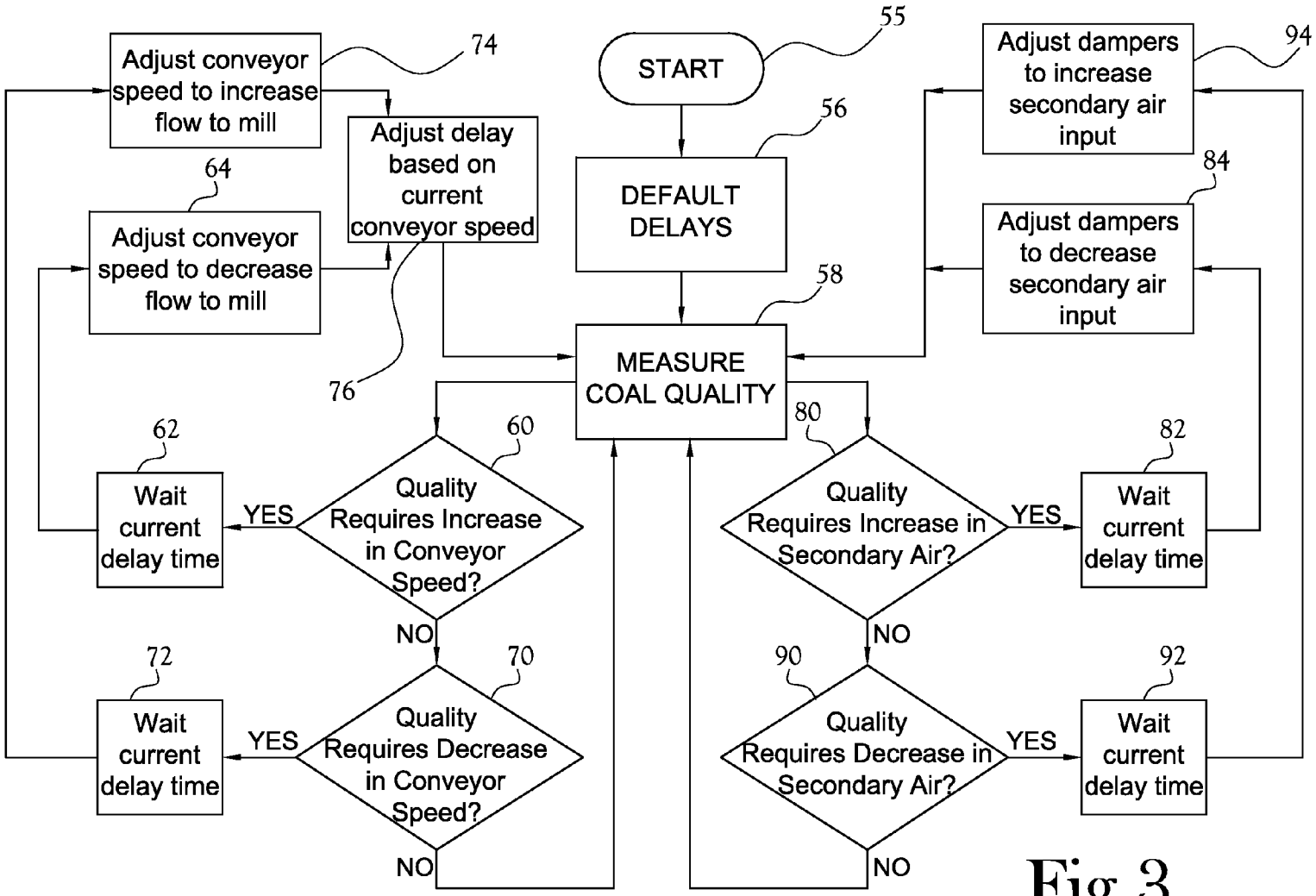
FIG. 3 is a flow diagram of the method steps of one embodiment of the present invention.

FIG. 3 illustrates generally the logic by which the processor 18 operates. When a coal-burning system is initiated 55, a default first delay value and a default second delay value are determined 56 for that particular system, with the default first delay value being based on a default through-flow rate for the coal feeder 30 and the distance between the position where the DGA/MGA device 10 collects the coal quality information and the position of the pulverizer 32 ("the conveyance distance"); and with the default second delay value being based on the time that the coal is processed in the pulverizer 32 and the time required to move pulverized coal and primary air from the pulverizer to the burner 36, where pulverized coal and primary air meet secondary air from the damper 34. As coal is moved through the coal feeder tube 28, the DGA/MGA device 10 analyzes the coal 24 to collect coal quality information, as shown at 58. The processor 18 then determines, at 60, whether the coal quality information for the coal 24 just analyzed is such that the conveyor speed needs to be increased. If an increase in conveyor speed is required, then the processor 18 delays for a period equal to the current first delay value, as shown at 62; then the processor 18 signals the conveyor 41 to increase the conveyor speed, as shown at 64. The processor 18 also determines, at 70, whether the coal quality is such that the conveyor speed needs to be decreased. If a decrease in conveyor speed is required, then the processor 18 delays for a period equal to the current first delay value, as shown at 72; then the processor 18 signals the conveyor 41 to increase the conveyor speed, as shown at 74. If the conveyor speed has been increased or decreased, then the processor 18 recalculates a new first delay value based on the current conveyor speed and the conveyance distance, as shown at 76. This adjusted first delay value is then used in the next iteration of the process.

The processor 18 also sends signals to adjust the volume of secondary air sent by the dampers 34 into the burner 36. As coal is moved through the coal silo feeder tube 28, the DGA/MGA device 10 analyzes the coal 24, as shown at 58. The processor 18 then determines, at 80, whether the coal quality information for the coal 24 just analyzed is such that the secondary air level should be increased (i.e. the volume of secondary air and the amount of $O_2$ introduced into the burner increased). If the secondary air level does need to be increased, then the processor delays for a time period equal to the current delay period, as shown at 82. (During the first iteration of the process, this current delay period will be the default delay period set at 56, substantially equal to the first delay value plus the second delay value; if the conveyor speed has been altered, then the current delay period will be recalculated to take account of the adjusted first delay value, as shown at 76.) After waiting for the current delay period, the processor 18 signals the dampers 34 to increase the secondary air level, as shown at 84. The processor 18 also determines, at 90, whether the coal quality is such that the secondary air level should be decreased (i.e. the volume of secondary air and the amount of $O_2$ introduced into the burner decreased). If the secondary air level does need to be decreased, then the processor delays for a time period equal to the current delay period, as shown at 92. (During the first iteration of the process, this current delay period will be the default delay period set at 56, substantially equal to the first delay value plus the second delay value; if the conveyor speed has been altered, then the current delay period will be recalculated to take account of the adjusted first delay value, as shown at 76.) After waiting for the current delay period, the processor 18 signals the dampers 34 to decrease the secondary air level, as shown at 94. If the coal quality is such that the secondary air level does not need increasing or decreasing, then the processor 18 does nothing with respect to the operation of the dampers 34. In each case where the dampers 34 are adjusted, by waiting for the expiration of the delay, the secondary air ($O_2$) level is appropriately increased or decreased according to the corresponding fuel heating value.

These steps are repeated continuously throughout the operation of the system. The present method has the distinct advantage over all current $NO_x$ lowering methodologies in that it continuously monitors, in real time, the coal quality information for coal 24 flowing to the burners 36 instead of relying on an assumed value that may or may not be accurate. It should be noted that the actual conveyor speed calibration and the actual damper modification might be performed by existing control equipment in response to a signal provided by the present invention as opposed to direct modification of the dampers themselves by the present invention with no loss of generality. It will be recognized that in some embodiments the apparatus of the present invention adjusts the flow of fuel into the pulverizer by adjusting the through-flow rate of the coal feeder rather than or in addition to adjusting the speed of the conveyor. It will also be recognized that in some embodiments the flow of fuel into the burner is calibrated by adjusting the flow of air from the primary air fan or air supply.

From the foregoing description, it will be recognized by those skilled in the art that a method and an apparatus for continuous real time heating value/coal flow balancing of coal from a coal feeder to a burner has been provided. The apparatus provides for a DGA/MGA device disposed for measuring coal quality at a specific location—between a coal silo/bunker and a coal feeder—in a coal fired plant in order to control the parameters of the plant according to the measured coal quality. By strategically placing the DGA/MGA device, continuous accurate real-time coal quality information is accomplished for making individual adjustments in order to improve individual burner stoichiometries to optimize performance of the system.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, what is claimed is:

1. An apparatus for adjusting the air/fuel ratio of a burner for the boiler of a coal-firing system based on coal quality information, said apparatus comprising:

a dual-energy/multi-energy gamma attenuation device positioned to obtain an energy spectrum for coal passing from the output of a coal bunker in the coal-firing system and the input of a coal feeder in the coal-firing system; and a processor receiving data from said dual-energy/multi-energy gamma attenuation device, said processor adapted to communicate with the controls for the coal feeder, said processor executing a program for adjusting the air/fuel ratio comprising the steps of:

determining coal quality information of the coal based on said energy spectrum;

determining the first delay value representing the amount of time required for the coal to be conveyed from the coal bunker to a pulverizer in the coal firing system by the coal feeder based on the current velocity of a conveyance included in the coal feeder;

determining a second delay value representing the amount of time required for the coal to be pulverized and the coal to be carried from the pulverizer to the burner of the coal firing system based on the velocity of a primary air supply flowing from the pulverizer to the burner;

selecting an air/fuel ratio of air to pulverized coal supplied to the burner for controlling the stoichiometry of the burner based on said coal quality information of the coal;

calculating an air supply rate and a coal supply rate required to produce the selected air/fuel ratio at the burner based on the energy content derived from said coal quality information of the coal;

selecting a velocity for the conveyance to supply coal at the calculated coal supply rate; and adjusting the velocity of the conveyance to the selected velocity and air supply rate after a time delay equal to the sum of said first delay value and said second delay value, causing the air/fuel ratio of the burner to be adjusted contemporaneously with the arrival of the coal on which the air/fuel ratio is based whereby the burner stoichiometry is controlled.

2. The apparatus of claim 1 wherein the coal feeder in the coal-firing system is a gravimetric coal feeder.

3. The apparatus of claim 1 further comprising a prompt gamma neutron activation analysis device, said prompt gamma neutron activation analysis device being in communication with said processor.

4. The apparatus of claim 1 further comprising a full stream elemental analyzer adapted to analyze and provide information about the coal in the bunker, said full stream elemental analyzer being in communication with said processor, wherein said full stream elemental analyzer adapted communicates said coal information to said processor and said processor incorporates said information in calculating the air supply rate and the coal supply rate required to produce the selected air/fuel ratio at the burner.

5. The apparatus of claim 4 wherein said coal information stored by said full stream elemental analyzer includes slagging information.

6. The apparatus of claim 4 wherein said coal information stored by said full stream elemental analyzer includes the elemental composition of the coal.

7. A device for continuous real time heating value/coal flow balancing of coal to a burner, said device being used in association with a coal-firing system including at least a coal feeder for receiving coal to be fired and for passing the coal to a conveyor and a conveyor for delivering the coal to a pulverizer for pulverizing the coal, said device comprising:

a dual-energy Gamma Attenuation (DGA)/multi-energy Gamma Attenuation (MGA) device for measuring the quality of coal, said DGA/MGA device measuring coal quality flow rate as the coal is supplied to the coal feeder, said DGA/MGA device including:

at least one DGA/MGA source positioned proximate to a location near where coal is received by the coal feeder;

at least one DGA/MGA detector positioned to detect high energy gamma rays transmitted from the DGA/MGA source through the coal; and a DGA/MGA data acquisition unit for reading output from said at least one DGA/MGA detector; and a processor in communication with said DGA/MGA data acquisition unit for processing, said processor further in communication with said conveyor, said processor being adapted to control said conveyor in response to the coal quality information;

wherein a coal feeder delay is determined based on a distance between said DGA/MGA device and an output of said coal feeder conveyor, and wherein said processor signals the coal feeder conveyor in response to the coal quality information, said processor signaling the coal feeder after said coal feeder delay whereby the coal feeder conveyor speed is adjusted based on the coal quality information for a selected volume of coal as the selected volume of coal is processed through the coal feeder.

8. A device for continuous real time heating value/coal flow balancing of coal to a burner, said device being used in association with a coal-firing system including at least a coal feeder for receiving coal to be fired and for passing the coal to a conveyor and a conveyor for delivering the coal to a pulverizer for pulverizing the coal, said device comprising:

a dual-energy Gamma Attenuation (DGA)/multi-energy Gamma Attenuation (MGA) device for measuring the quality of coal, said DGA/MGA device measuring coal quality flow rate as the coal is supplied to the coal feeder, said DGA/MGA device including:

at least one DGA/MGA source positioned proximate to a location near where coal is received by the coal feeder;

at least one DGA/MGA detector positioned to detect high energy gamma rays transmitted from the DGA/MGA source through the coal; and a DGA/MGA data acquisition unit for reading output from said at least one DGA/MGA detector;

a processor in communication with said DGA/MGA data acquisition unit for processing, said processor further in communication with said conveyor, said processor being adapted to control said conveyor in response to the coal quality information; and an air system for mixing pulverized coal with air to create a coal/air fuel, a burner for burning the fuel, and an air damper for controlling air introduced to the fuel at the burner, wherein a delay is determined based on a distance between said DGA/MGA device and the air damper, and wherein said processor signals the at least one secondary air damper in response to the coal quality information, said processor signaling the air damper after said delay whereby the air damper is adjusted according to the coal quality information for a selected volume of coal as the selected volume of coal is processed through the burner.

9. A method for adjusting the air/fuel ratio of a burner in the boiler of a coal firing system based on the chemical composition of the coal to control the burner stoichiometry, said method comprising the steps of:

providing a dual-energy/multi-energy gamma attenuation device between the output of a coal bunker and the input of a coal feeder in the coal firing system;

obtaining an energy spectrum for coal passing through said dual/multi energy gamma analyzer;

determining coal quality information of the coal based on said energy spectrum;

determining the first delay value representing the amount of time required for the coal to be conveyed from said dual-energy/multi-energy gamma attenuation device to a pulverizer in the coal firing system by the coal feeder based on the current velocity of a conveyance included in the coal feeder;

determining a second delay value representing the amount of time required for the coal to be pulverized in the pulverizer and for the coal to be carried from the pulverizer to the burner of the coal firing system based on the velocity of a primary air supply flowing from the pulverizer to the burner;

selecting an air/fuel ratio of air to pulverized coal supplied to the burner for controlling the stoichiometry of the burner based on said coal quality information of the coal;

supplying a secondary air supply flowing to the burner;

calculating an air supply rate and a coal supply rate required to produce the selected air/fuel ratio at the burner based on the energy content derived from said coal quality information of the coal;

selecting a velocity of the conveyance to supply coal at the calculated coal supply rate;

selecting a setting for a secondary air damper to supply secondary air to the burner at the calculated air supply rate; and adjusting the velocity of the conveyance to the selected velocity and adjusting the air supply rate after waiting for a period of time substantially equal to the sum of said first delay value and said second delay value, causing the air/fuel ratio of the burner to be adjusted contemporaneously with the arrival of the coal on which the air/fuel ratio is based whereby the burner stoichiometry is controlled.

10. A method for operating a coal-firing system providing continuous real time heating value/coal flow balancing of coal; said system comprising a coal feeder, a coal feeder conveyor, a pulverizer for pulverizing coal, a primary air system for introducing air to the pulverized coal to create a coal/air fuel, a burner for burning the fuel, a secondary air system for introducing air to the coal/air fuel at the burner, a dual-energy Gamma Attenuation (DGA)/multi-energy Gamma Attenuation (MGA) device for analyzing coal to gather coal quality information at a location near where the coal enters the coal feeder, and a controller receiving coal quality information from the DGA/MGA device and controlling the coal feeder, the coal feeder conveyor, and the secondary air system in response to the coal quality information in order to control a stoichiometry at the burner, said method comprising the steps of:

(a) acquiring coal quality information;

(b) determining whether the coal quality information of coal presented to said coal feeder conveyor requires a change in conveyor speed due to a variation in coal quality information:

(c) signaling said coal feeder conveyor to change conveyor speed based on the variation in coal quality information:

(d) determining a coal feeder delay approximately equal to a time required for the coal to travel from said DGA/MGA device to one of said pulverizer and said burner; and (e) waiting for a period of time substantially equal to said delay before performing said step of (c) signaling said coal feeder conveyor to change rate according to the variation in coal quality information.

11. A method for operating a coal-firing system providing continuous real time heating value/coal flow balancing of coal: said system comprising a coal feeder, a coal feeder conveyor, a pulverizer for pulverizing coal, a primary air system for introducing air to the pulverized coal to create a coal/air fuel, a burner for burning the fuel, a secondary air system for introducing air to the coal/air fuel at the burner, a dual-energy Gamma Attenuation (DGA)/multi-energy Gamma Attenuation (MGA) device for analyzing coal to gather coal quality information at a location near where the coal enters the coal feeder, and a controller receiving coal quality information from the DGA/MGA device and controlling the coal feeder, the coal feeder conveyor, and the secondary air system in response to the coal quality information in order to control a stoichiometry at the burner, said method comprising the steps of:

(a) acquiring coal quality information;

(b) determining whether the coal quality information of coal presented to said coal feeder conveyor requires a change in conveyor speed due to a variation in coal quality information;

(c) signaling said coal feeder conveyor to change conveyor speed based on the variation in coal quality information;

(d) determining whether the coal quality information of coal presented to the burner indicates a change in the air level in the burner;

(e) signaling said secondary air system to change the level of air introduced to the burner based on the indicated change in air level in the burner;

(f) determining a secondary air delay approximately equal to a time required for the coal to travel from said DGA/MGA device to the burner; and (g) signaling said secondary air system to change the level of air introduced to the burner based on said secondary air delay.

* * * * *